United States Patent [19]

Reinhard et al.

[11] 4,226,732

[45] Oct. 7, 1980

[54] SYNTHETIC AIRCRAFT TURBINE OIL

[75] Inventors: Russell R. Reinhard, Hopewell Junction; Roberta Yaffe, Beacon, both of N.Y.

[73] Assignee: Texaco Inc., White Plains, N.Y.

[21] Appl. No.: 920,938

[22] Filed: Jun. 30, 1978

[51] Int. Cl.[2] ..... C10M 1/44

[52] U.S. Cl. ..... 252/32.5; 252/34.7; 252/46.7; 252/47.5; 252/56 S

[58] Field of Search ..... 252/34.7, 46.7, 47.5, 252/56 S, 32.5

[56] References Cited

U.S. PATENT DOCUMENTS

| | | | |
|---|---|---|---|
| 2,681,316 | 6/1954 | Harle | 252/47.5 |
| 2,691,632 | 10/1954 | Harle | 252/47.5 X |
| 3,427,245 | 2/1969 | Hotten | 252/34.7 |
| 3,462,368 | 8/1969 | Wollensak et al. | 252/47.5 X |
| 3,843,531 | 10/1974 | Nebzyooski et al. | 252/34.7 |
| 4,096,078 | 6/1978 | Yaffe | 252/56 SX |
| 4,124,513 | 11/1978 | Yaffe | 252/46.7 |

FOREIGN PATENT DOCUMENTS

| | | | |
|---|---|---|---|
| 1502381 | 12/1966 | France | 252/51.5 A |
| 1180387 | 2/1970 | United Kingdom | 252/32.5 |

*Primary Examiner*—Delbert E. Gantz
*Assistant Examiner*—Andrew Metz
*Attorney, Agent, or Firm*—Carl G. Ries; Robert A. Kulason; James F. Young

[57] ABSTRACT

Synthetic lubricating oil composition having improved oxidation stability comprising a major portion of an aliphatic ester base oil having lubricating properties, formed by the reaction of pentaerythritol and an organic monocarboxylic acid and containing a phenylnaphthylamine, a dialkyldiphenylamine, a hydrocarbyl phosphate ester, a polyhydroxy anthraquninone, an alkylamine salt of 3-amino-triazole-dodecenylsuccinamic acid, 2-hydroxylpropyl-N,N-dibutyldithiocarbamate, and an alkyl amine salt of a methyl acid phosphate.

16 Claims, No Drawings

SYNTHETIC AIRCRAFT TURBINE OIL

BACKGROUND OF THE INVENTION

Field of the Invention

This invention is concerned with a pentaerythritol ester base lubricating oil composition for a gas turbine engine. Gas turbine engines are operated under a wide range of temperature conditions. The lubricant must be fluid at extremely low temperatures and at the same time retain its lubricating properties in an engine which produces internal operating temperatures at 450°–550° F. or above. The lubricant is subjected to severe oxidation stresses under the high running temperatures encountered in such engines.

Ester base lubricating oil compositions prepared from pentaerythritol and a mixture of fatty acids and containing selected additive combinations are well known. These lubricants are functional over a wide temperature range and exhibit good thermal and oxidative stability. The search for a still more effective, long lived ester base lubricant composition, however, is a major goal of lubricant manufacturers. In addition, more advanced gas turbine engines currently being developed and tested will put higher stresses on the lubricant composition and are projected to require improved lubricant compositions.

SUMMARY OF THE INVENTION

The synthetic lubricating oil composition of the invention comprises a major portion of an aliphatic ester base containing a phenyl naphthylamine, a dialkyldiphenylamine, a hydrocarbyl phosphate ester, a polyhydroxy-substituted anthraquinone, an alkylamine salt of 3-aminotriazole-dodecenyl-succinamic acid, 2-hydroxylpropyl-N,N-dibutyldithiocarbamate, and an alkylamine salt of a methyl acid phosphate. More specifically, the lubricating oil composition of the invention consists of a major portion of an aliphatic ester base oil formed from the reaction of pentaerythritol and an organic monocarboxylic acid having from about 2 to 18 carbon atoms per molecule and containing:

(a) from about 0.3 to 5 percent by weight of the lubricating oil composition of phenyl naphthylamine or an alkyl or alkaryl derivative of phenyl naphthylamine in which the alkyl radical contains from 4 to 12 carbon atoms, (b) from about 0.3 to 5 percent by weight of a dialkyldiphenylamine in which the alkyl radical contains from 4 to 12 carbon atoms, (c) from about 0.25 to 10 percent by weight of a hydrocarbyl phosphate ester in which said hydrocarbyl radical containing an aryl ring and has from about 6 to 18 carbon atoms, (d) from about 0.01 to 0.5 percent by weight of a polyhydroxyanthraquinone, (e) from 0.05 to 1.0 percent by weight of an alkylamine salt of 3-aminotriazole-dodecenylsuccinamic acid and, (f) from 0.005 to 0.50 percent by weight of 2-hydroxypropyl-N,N-dibutyldithiocarbamate, and (g) from 0.001 to 0.10 percent by weight of an alkylamine salt of a methyl acid phosphate.

The lubricating oil composition of the invention provides substantial improvements in oxidative stability, particularly excellent control of acidity and viscosity increase under severe oxidizing conditions. It also provides simultaneous improvements in wear and rust inhibition.

DETAILED DESCRIPTION

The base fluid component of the composition of the invention is an ester base fluid prepared from pentaerythritol and a mixture of hydrocarbyl monocarboxylic acids. Polypentaerythritols, such as dipentaerythritol, tripentaerythritol and tetrapentaerythritol can also be employed in the reaction to prepare the base oil.

The hydrocarbon monocarboxylic acids which are used to form the ester-base fluid include the straight-chain and branched-chain aliphatic acids, as well as mixtures of these acids. The acids employed have from about 2 to 18 carbon atoms per molecule, and preferably from about 5 to 10 carbon atoms. Examples of suitable acids are acetic, propionic, butyric, valeric, isovaleric, caproic, decanoic, dodecanoic, tertiarybutylacetic and 2-ethylhexanoic acid, including mixtures.

In general, the acids are reacted in proportions leading to a completely esterified pentaerythritol or polypentaerythritol with the preferred ester bases being the pentaerythritol tetraesters. Examples of such commercially available tetraesters include pentaerythritol tetracaproate, which is prepared from purified pentaerythritol and crude caproic acid containing other $C_{5-10}$ monobasic acids. Another suitable tetraester is prepared from a technical grade pentaerythritol and a mixture of acids comprising 38 percent valeric, 13 percent 2-methyl pentanoic, 32 percent octanoic and 17 percent pelargonic acids, by weight.

The ester base fluid comprises the major portion of the fully formulated synthetic ester base lubricating oil composition. In general, this ester base fluid is present in concentrations from about 90 to 98 percent of the composition, by weight. The essential alkyl or alkaryl phenyl naphthylamine component of the invention is represented by the formula:

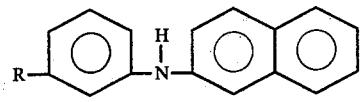

in which R may be H or is an alkyl radical containing from about 4 to 12 carbon atoms or an alkaryl radical containing from 7 to 12 carbon atoms. This radical can be straight or branched chain alkyl radical with the tertiary alkyl structure being preferred or it can be an alkaryl radical.

Specific effective compounds of this class include α- or β-phenylnaphthylamine, N-(para-tertiary-octylphenyl)-α- or β-naphthylamine, N-(4-cumylphenyl)α- or β-naphthylamine and the corresponding paratertiary-dodecylphenyl and paratertiary-butylphenyl α-and β-naphthylamines. The preferred naphthylamines are those in which R is H or a tertiary alkyl radical having from 6 to 10 carbon atoms therein. The preferred concentration of this component is from about 0.5 to 2.5 percent by weight.

Another essential component of the lubricating oil composition of the invention is a dialkyldiphenylamine. These compounds are represented by the formula:

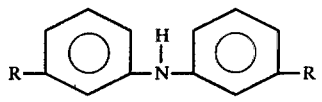

in which R is an alkyl radical having from about 4 to 12 carbon atoms. Suitable alkylamines include dioctyldiphenylamine, didecyldiphenylamine, didodecyldiphenylamine, dihexyldiphenylamine and similar compounds. Dioctyldiphenylamine is the preferred compound and the preferred concentration is from 0.5 to 2.0 percent by weight. Another essential component of the lubricating oil composition of the invention is a hydrocarbyl phosphate ester, more specifically a trihydrocarbyl phosphate in which the hydrocarbyl radical is an aryl or alkaryl radical or mixture thereof containing from 6 to 18 carbon atoms and preferably from 6 to 12 carbon atoms. Effective specific compounds include tricresylphosphate. These compounds are preferably in the lubricating oil composition in a concentration ranging from about 0.5 to 5 wt. %.

The essential metal deactivator of the lubricating oil composition of the invention is a polyhydroxyanthraquinone. Suitable compounds in this class are the dihydroxyanthraquinones such as 1,4-dihydroxyanthraquinone and 1,5-dihydroxyanthraquinone and the higher polyhydroxyanthraquinones such as 1,2,5,8 tetrahydroxyanthraquinone. The preferred concentration of this component is from about 0.05 to 0.15 weight percent.

Another essential component of the lubricating oil composition of the invention is an alkylamine salt of 3-aminotriozale-dodecenylsuccinamic acid. Preparation of this salt is disclosed in assignee's copending application Ser. No. 776,689 filed Mar. 11, 1977, entitled Synthetic Aircraft Turbine Oil, the disclosure thereof being incorporated herein by reference.

Suitable alkylamine salts of 3-aminotriazoledodecenylsuccinamic acid, include compounds where the basic portion of the salt is t-octylamine, dicyclohexylamine, or commercial alkyl amines such as Primene JMT, Primene 81R and Armeen L-15.

Particularly preferred salts are the t-octylamine salts of 2-dodecenyl-N-(3-1,2,4-triazolyl)-succinamic Acid and the corresponding 3-dodecenyl derivative, with the 2-dodecenyl-derivative being especially preferred for the most satisfactory results.

This component is present in the composition in an amount of from about 0.05 to 1.0%, by weight. The preferred concentration range is from 0.05 to 0.2% by weight for most satisfactory results.

Another essential component of the invention is 2-hydroxylpropyl N,N-dibutyldithiocarbamate. This component is present in the composition in an amount of from about 0.005 to 0.5% by weight. The preferred concentration range is from about 0.01 to 0.10 by weight.

The final essential component of the invention is an amine salt of a alkyl acid phosphate. Suitable materials include the salt of aliphatic amines containing 2 to 30 carbon atoms with alkyl acid phosphates of structures I and II where R is an alkyl group containing from 1 to 15 carbon atoms.

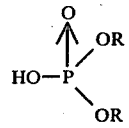

I

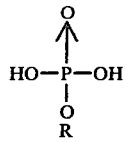

II

The preferred amine salt is obtained from a tertiary alkyl primary amine containing 12–15 carbon atoms, straight chain or branched or mixed in the alkyl group thereof and an admixture of monomethyl di-hydrogen phosphate and di-methyl hydrogen phosphate. This component is present in the composition in an amount of from 0.001 to 0.10% by weight, preferably 0.002 to 0.04% by weight.

The novel lubricating oil compositions of the present invention exhibit outstanding thermal and oxidative stability, and effectively reduce or prevent metal staining or corrosion. In addition they provide particularly excellent control of acidity and viscosity increase under severe oxidizing conditions.

These valuable properties were obtained with a critically balanced and formulated synthetic ester base lubricating oil blend. The results obtained were surprising and unexpected in that they equal or surpass an outstanding commercial synthetic ester base lubricating composition.

The ester base oil employed in preparing the lubricating oil compositions of the invention comprised pentaerythritol containing a minor amount of dipentaerythritol esterified with a mixture of fatty acids. It consisted of technical grade pentaerythritol ester made from a mixture of carboxylic acids consisting of (mole %):

| | |
|---|---|
| i-$C_5$ | 8 ± 3% |
| n-$C_5$ | 23 ± 5% |
| n-$C_6$ | 20 ± 5% |
| n-$C_7$ | 27 ± 5% |
| n-$C_8$ | 7 ± 3% |
| n-$C_9$ | 16 ± 3% |

This ester base oil had the following properties:

| | |
|---|---|
| Viscosity, cs at 210° F. | (5.01) |
| Viscosity, cs at 100° F. | (25.6) |
| Viscosity, cs at −40° F. | (7005) |
| Viscosity Index | (140) |
| Flash, °F. | (515) |

The above ester oil in an amount of 95.9 wt. % was blended with 1.0 wt. % phenyl-α-naphthylamine, 1.0 wt. % 4,4' dioctyldiphenylamine, 2.0 wt. % tricresyl phosphate and 0.1 wt. % quinizarin to form a base fluid. The base fluid (Comparative Example A) was a fully formulated composition meeting the requirements of the MIL-L-23699B specification.

The lubricating compositions of the invention were blended using the same ester oil and with the hereinbefore prescribed essential components thereof. The composition of one of the lubricants of the invention is shown in the following Table I.

The oxidation stability of the lubricants of the invention as compared to the Base Fluid as well as a fully formulated commercial oil was determined in the Rolls Royce (RR 1001) Oxidation Test. (D. Eng. R.D. 2497 Supplement Method No. 12). The results are set forth in the following Table.

TABLE I

| | Ex. I | COMPARATIVE Ex. A |
|---|---|---|
| Ester Oil | 96.75 | 95.9 |
| PAN (1) | 1.0 | 1.0 |
| DODPA (2) | 1.0 | 1.0 |
| TCP (3) | 1.0 | 2.0 |
| Quinizarin | 0.1 | 0.1 |
| 3-ATR-DSAA (4) | 0.1 | |
| OD-711 (5) | 0.05 | |
| VANLUBE 672 ppm (6) | 25. | |

(1) PAN - Phenyl-α-naphthylamine
(2) DODPA - 4,4'-Dioctyldiphenylamine
(3) TCP - Tricresyl phosphate
(4) 3-ATR-DSAA - t-octylamine salt of 3-aminotriazole dodecenylsuccinamic acid
(5) OD-711 - 2-hydroxypropyl-N,N-dibutyldithiocarbamate
(6) VANLUBE 762 - tertiary alkyl primary amine salt of monomethyl hydrogen phosphate and dimethyl hydrogen phosphate

ROLLS ROYCE (RR 1001)
OXIDATION TEST RESULTS
225° C./48 HRS.

| | Example I | Comparative Example A |
|---|---|---|
| % Viscosity Increase, 100° F. | 37.1 | 302.5 |
| Acidity Increase, mg KOH/g | 4.55 | 6.53 |
| % Volatility Loss | 16.8 | 41.3 |
| % Insolubles | 0.002 | 0.005 |

The data in the above Table I show that the compositions of the present invention, (Example I) is superior to a base oil blend (Example A) in every respect in this Oxidation Test. The % Viscosity Increase is markedly less, the Acidity Increase is considerably lower, the Volatility Loss is significantly lower and the % Insolubles lower.

In another series of tests, the compositions of Example I and comparative Example A were evaluated in the Shell 4-Ball Wear Tester. The test conditions were 1800 rpm with a 10 kg load applied. The test was run for 1 hour at 350° F.

The results are as follows:

TABLE II

4-BALL WEAR RESULTS

| | EXAMPLE I | COMPARATIVE EXAMPLE A |
|---|---|---|
| Scar Diameter, mm | 0.36 | 0.62 |

The results demonstrate the superior anti-wear properties of the composition of the invention.

In another series of tests to determine the effectiveness of the rust inhibiting qualities of the composition of the invention, an evaluation was undertaken in accordance with the ASTM-D-665, Test Procedure, Modified by U.S. Navy Experimental specification XAS-2354A.

The ASTM Test, as modified, requires the valuation to be made at 100° F. after 6 hours duration using 10 vol. % synthetic sea water in oil.

The test results are set forth below.

TABLE III

RUST INHIBITION

| COMPOSITION | RESULTS |
|---|---|
| Example I | No Rust, Pass. |
| Comparative Example A* | 50% Rust, Fail. |
| Comparative Example B* | 50% Rust, Fail. |

*a fully formulated commercial oil of MIL-L-23699B quality.

These data clearly show the superiority of the compositions of the present invention over the base oil blend, Example A, and a commercial product in terms of rust inhibition.

The lubricating oil compositions of the present invention were further evaluated in the following specifications: Pratt & Whitney Aircraft PWA 521C, the U.S. Navy MIL-L-23699B, Allison EMS 53, the General Electric D 50TF1-S4 and D 50TF3-S4 and were found to meet the physical properties and performance requirements of these specifications in as far as can be determined in the laboratory.

Obviously, many modifications and variations of the invention as hereinbefore set forth may be made without departing from the spirit and scope thereof and therefore only such limitations should be imposed as are indicated in the appended claims.

We claim:

1. A synthetic lubricating oil consisting of a major portion of an aliphatic ester base oil having lubricating properties formed from the reaction of pentaerythritol or a polypentaerythritol or trimethylolpropane and an organic monocarboxylic acid having from about 2 to 18 carbon atoms per molecule containing:
   (a) from about 0.3 to 5 percent by weight of the lubricating oil composition of a phenylnaphthylamine or an alkyl or alkaryl phenyl napthylamine in which the alkyl radical has from 4 to 12 carbon atoms,
   (b) from about 0.3 to 5 percent by weight of a dialkyldiphenylamine in which the alkyl radical has from 4 to 12 carbon atoms,
   (c) from about 0.25 to 10 percent by weight of a hydrocarbyl phosphate ester in which said hydrocarbyl radical contains an aryl ring and contains from about 6 to 18 carbon atoms,
   (d) from about 0.01 to 0.5 percent by weight of a polyhydroxy-substituted anthraquinone,
   (e) from about 0.05 to 1.0 percent by weight of a t-alkylamine salt of 3-aminotriazole-dodecenyl-succinamic acid,
   (f) from about 0.005 to 0.50 percent by weight of 2-hydroxylpropyl-N,N-dibutyldithiocarbamate, and
   (g) from about 0.001 to 0.10 percent by weight of a tertiary alkylamine salt of methyl acid phosphate.

2. A lubricating oil composition as claimed in claim 1 containing from about 0.05 to about 0.2 percent by weight of said amine salt of 3-aminotriazole-dodecenyl-succinamic acid.

3. A lubricating oil composition as claimed in claim 1 wherein said amine salt of 3-aminotriazole-dodecenyl-succinamic acid is the t-octylamine salt of 2-dodecenyl-N-(3-1,2,4-triazolyl)-succinamic acid.

4. A lubricating oil composition as claimed in claim 1 wherein said amine salt of 3-aminotriazole-dodecenyl-succinamic acid is the t-octylamine salt of 3-dodecenyl-N-(3-1,2,4-triazolyl)-succinamic acid.

5. A lubricating oil composition as claimed in claim 1 containing from 0.5 to 2.5 percent by weight of said naphthylamine.

6. A lubricating oil composition as claimed in claim 1 wherein the naphthylamine is phenyl-alpha-naphthylamine.

7. A lubricating oil composition as claimed in claim 1 containing from 0.5 to 2.0 percent by weight of said dialkyldiphenylamine.

8. A lubricating oil composition as claimed in claim 1 wherein said dialkyldiphenylamine is 4,4'-dioctyldiphenylamine.

9. A lubricating oil composition as claimed in claim 1 containing from about 0.5 to 5 percent by weight of a hydrocarbyl phosphate ester.

10. A lubricating oil composition as claimed in claim 1 wherein said hydrocarbyl phosphate ester is tricresyl phosphate.

11. A lubricating oil composition as claimed in claim 1 containing from about 0.05 to 0.15 percent by weight of said polyhydroxy-substituted anthraquinone.

12. A lubricating oil composition as claimed in claim 1 wherein the polyhydroxy-substituted anthraquinone is 1,4-dihydroxyanthraquinone.

13. A lubricating oil composition as claimed in claim 1 containing from about 0.01 to 0.10 percent by weight of said 2-hydroxypropyl-N,N-dibutyldithiocarbamate.

14. A lubricating oil composition as claimed in claim 1 containing from about 0.002 to 0.04 percent by weight of said tertiary alkylamine salt of methyl acid phosphate.

15. A lubricating oil composition as claimed in claim 1 wherein said tertiary amine salt of methyl acid phosphate is an admixture of the tertiary alkyl amine salts of monomethyldihydrogen phosphate and di-methyl-monohydrogen phosphate.

16. A lubricating oil composition as claimed in claim 1 wherein the aliphatic ester base oil is present in a concentration of from about 90 to 98 percent by weight of the composition.

* * * * *